US005299507A

United States Patent [19]

Maynard, Sr.

[11] Patent Number: 5,299,507

[45] Date of Patent: Apr. 5, 1994

[54] RING GUIDEWAY FOR RAPID RAIL TRANSIT SYSTEM

[76] Inventor: Edward E. Maynard, Sr., 3247-A Cofer Rd., Richmond, Va. 23234

[21] Appl. No.: 18,526

[22] Filed: Feb. 17, 1993

[51] Int. Cl.[5] ..... B61B 5/00

[52] U.S. Cl. ..... 104/138.1; 104/124; 104/245

[58] Field of Search ..... 104/138.1, 123, 124, 104/125, 126, 23.1, 23.2, 245; 105/365

[56] References Cited

U.S. PATENT DOCUMENTS

| | | | |
|---|---|---|---|
| 456,215 | 7/1891 | D'Homergue | 104/119 |
| 495,927 | 4/1893 | Brott | 104/119 |
| 799,908 | 9/1905 | Humphrey | 104/124 |
| 1,058,481 | 4/1913 | Spelling | 105/144 |
| 1,061,214 | 5/1913 | Batcheller | 105/119 |
| 1,110,231 | 9/1914 | Putnam | 105/144 |
| 2,296,771 | 2/1938 | Crawford et al. | 104/138.1 |
| 3,006,288 | 10/1961 | Brown | 104/124 |
| 3,094,942 | 6/1963 | Blumel | 104/138.1 |
| 3,540,068 | 11/1970 | Bouthors | 104/124 |
| 3,669,026 | 6/1972 | Mouritzen | 104/118 |
| 4,029,019 | 6/1977 | Watkins | 104/124 |
| 4,034,678 | 7/1977 | Wilson | 104/125 |
| 4,221,170 | 9/1980 | Koudelka | 104/125 |
| 4,703,697 | 11/1987 | Bell | 104/23.1 |

*Primary Examiner*—Mark T. Le

*Attorney, Agent, or Firm*—Spencer, Frank & Schneider

[57] ABSTRACT

A guideway for a vehicle includes a plurality of circular support rings spaced apart along a desired path of travel. The rings are mounted to a surface of the earth and braced against movement. A load bearing surface extends through the respective rings for accommodating the major load of the vehicle. Two roller wheel guide plates extend through the rings, and are spaced apart and mounted on an inner circumference of the rings for guiding the vehicle through rolling engagement with corresponding guide wheels mounted on the vehicle.

9 Claims, 2 Drawing Sheets

RING GUIDEWAY FOR RAPID RAIL TRANSIT SYSTEM

BACKGROUND OF THE INVENTION

The present invention relates to the field of rapid transit systems, and more particularly to a guideway for a high speed rail transportation system.

With the passage of the Intermodal Surface Transportation Efficiency Act of 1991, there is a renewed national interest in developing high speed, energy efficient, environmental sound, and cost effective rail transportation systems. The present invention is directed toward achieving these objectives.

One problem with prior attempts to develop high speed trains is that at higher speeds, the trains must slow down to travel along a curved track. Another problem with such prior attempts to is that the theoretical top speed of the train, along even straight track, cannot be reached because existing track is utilized that is structurally not capable of supporting the higher speeds. A further problem is that the cost to develop and implement new technology required for high speed trains has been exorbitant.

SUMMARY OF THE INVENTION

It is an object of the present invention to provide a novel guideway for a high speed, rapid transit system that will allow the use of aerodynamically designed vehicles that can traverse curves in the guideway at substantially the same speed as straight guideway paths.

It is a further object of the present invention to provide a cost effective, rapid transit system by providing a guideway that will permit the use of existing aerodynamically designed fuselages that have been developed for modern day aircraft as the vehicle on the guideway.

The above and other objects are accomplished in accordance with the invention by the provision of a guideway for a vehicle including a plurality of circular support rings spaced apart along a desired path of travel; structure for mounting each ring to a surface of the earth and for bracing each ring against movement; a load bearing surface extending through the respective rings for accommodating the major load of the vehicle; and two guide plates extending through the rings, the guide plates being spaced apart and mounted on an inner circumference of the rings for guiding the vehicle through rolling engagement with corresponding guide wheels mounted on the vehicle.

According to one aspect of the invention, the load bearing surface constitutes a monorail mounted in a lower region of the rings, with the guide plates located in an upper region of the ring and equally displaced from the monorail in the circumferential direction. On a straight guideway path the monorail is aligned with a vertical axis that passes through the center of the ring and dead center bottom of the ring, and the guide plates are mounted at an identical angular displacement in the circumferential direction with respect to the dead center bottom of the rings. For curved guideway paths, the monorail is offset from the vertical axis and the guide plates are correspondingly displaced in the circumferential direction of the rings to accommodate a banking of the vehicle along the curved path.

The circular ring structure of the guideway thus provides a structurally sound guideway and yet advantageously provides for banking of the vehicle in a mechanically simple and low cost manner. That is, banking of the vehicle is provided by essentially displacing the combination of the monorail and the running wheel guide plates, which necessarily have a fixed angular relationship relative to one another, around the ring as necessary to build the banking angle into the guideway. The vehicle, being constrained to the guideway, follows the banking angle and can therefore take curves at approximately the same speed as when traversing a straight path.

Additionally, fabrication of the guideway can be simplified since the structure for mounting the support ring desirably comprises a steel reinforced concrete base which may be prefabricated and structurally combined with the ring in advance at a factory.

Other objects, features, advantages and benefits of the invention will become apparent from the following detailed description of the invention taken in conjunction with the accompanying drawings.

DETAILED DESCRIPTION OF THE PREFERRED EMBODIMENT

Figure 1:
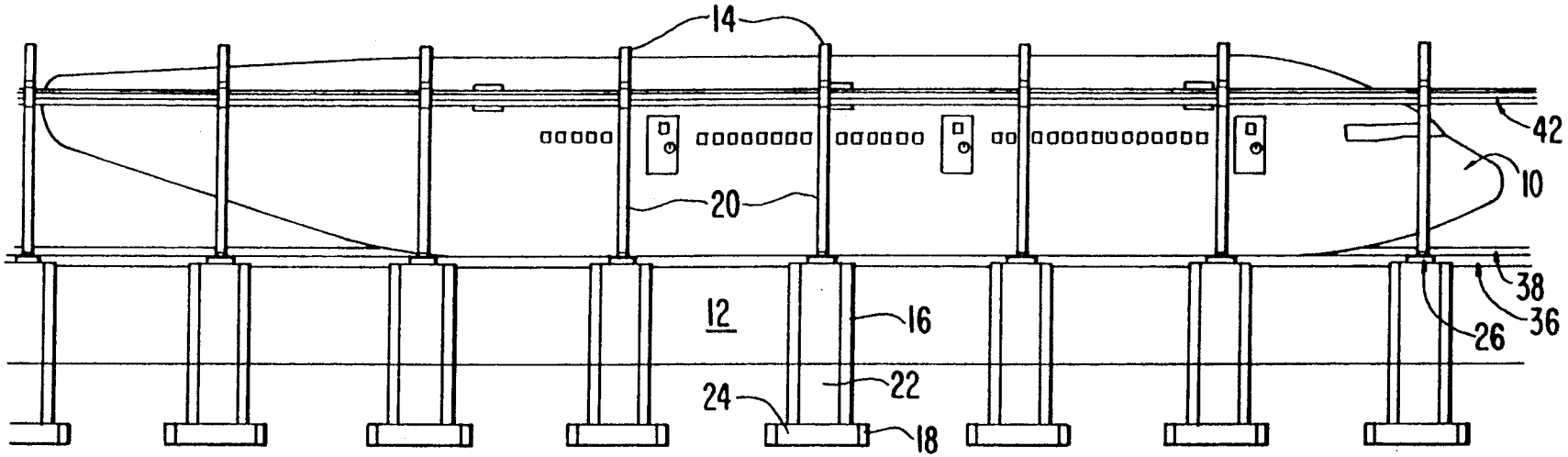
FIG. 1 is a side view of a vehicle on a guideway constructed in accordance with the invention.
Figure 5:
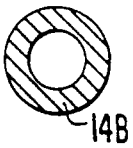
FIG. 5 is an enlarged cross-sectional view of FIG. 3 shown along sectional line III—III.
Figure 6:
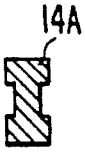
FIG. 6 is an enlarged cross-sectional view of FIG. 3 shown along sectional line III—III illustrating an alternative embodiment.

Referring to FIG. 1, there is shown a vehicle 10 positioned on a guideway 12 that incorporates the principles of the present invention. Guideway 12 comprises a plurality of circular support rings 14 spaced apart along a path of travel over the earth. Each ring 14 can be comprised, for example, of a steel I-beam 14A or pipe 14B bent in a circle, as illustrated in FIGS. 5 and 6, respectively. Referring back to FIG. 1, each ring 14 is mounted on a steel reinforced concrete base 16 resting on a subterranean concrete footing 18. Each ring 14 is stabilized by a pair of stabilizing braces 20 comprised, for example, of steel I-beams and connected between ring 14 and respective anchor columns 22. Anchor columns 22 are also preferably made of steel reinforced concrete and rest on respective subterranean concrete footings 24. Preferably, ring 14 is welded to one or more steel beams (not shown) embedded in concrete base 18.

Figure 2:
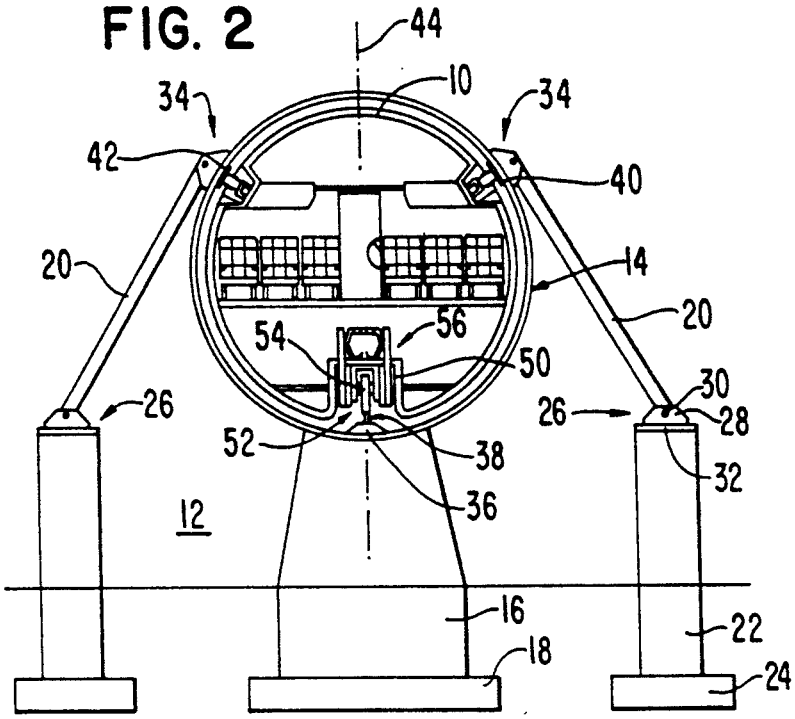
FIG. 2 is a sectional view of FIG. 1 along line AA.

Referring additionally to the cross sectional view of FIG. 2, each stabilizing brace 20 is connected to an anchor column 22 by way of a steel clevis 26 comprised of a cradle block 28 and a pivot bolt 30 which projects through an appropriate opening near the lower end of the brace. Cradle block 28 is in turn fixed to a base plate 32 mounted by bolts (not shown) to the top of column 22. The other end of each stabilizing brace 20 is fixed to ring 14 by a similar steel clevis 34 which is welded to the exterior surface of ring 14.

A steel reinforced concrete track base 36 mounting a monorail 38 extends through support rings 14 and is supported on top of the respective bases 16. Track base 36 is desirably fabricated in sections, for example 20 feet in length, the ends of which are appropriately fastened to bases 16 by bolts (not shown). Monorail 38 is also provided in sections, welded end to end and appropriately fastened to track base 36 by bolts (not shown).

Two guide wheel running plates 40, 42 extend through rings 14 parallel to rail 38 and are welded to the inner surface of the rings. Preferably, rail 38 and guide wheel running plates 40, 42 are equally spaced from one another around the circumference of rings 14. Thus, guide wheel running plates 40 and 42 each have an angular displacement of approximately 120° from the location of monorail 38 on the circumference of ring 14. Clevis's 34 for connecting braces 20 to ring 14 are welded to the exterior surface of ring 14 directly opposite the respective guide wheel running plates 40, 42.

Along a length of track that is straight with respect to the azimuth direction, monorail 38 is mounted coincident with an imaginary vertical line 44 that passes through the center of ring 14 and the dead center bottom of the ring as shown in FIG. 2, and braces 20 are of equal length.

Figure 3:
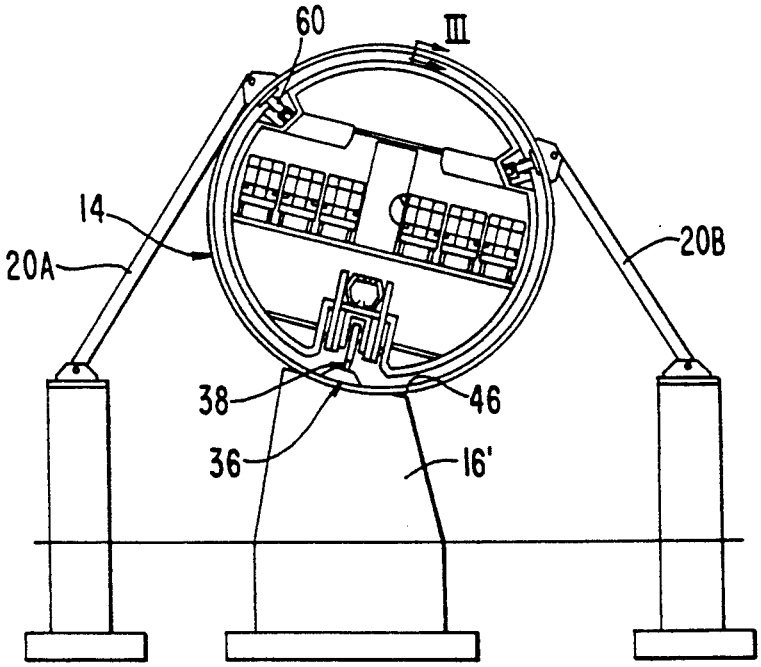
FIG. 3 is a similar sectional view as FIG. 3 showing a vehicle on the guideway at a 15° banking angle.

With reference to FIG. 3, to permit banking of vehicle 10 along a section of track that curves in the azimuth direction, monorail 38, along with its track base 36 are displaced off dead center bottom of ring 14 by as much as, for example 15°. Guide wheel running plates 40, 42 are displaced by a corresponding angular displacement in the circumferential direction of the ring so that the angular orientation of the guide wheel running plates relative to monorail 38 on ring 14 remains constant. Further, as shown in FIG. 3, clevis's 34 remain fixed to rings 14 opposite to the guide wheel running plates, so that the length of the ring braces must be correspondingly adjusted as shown by the relative lengths of braces 20A and 20B. FIG. 3 additionally shows a concrete base 16' having a top surface 46 which is sloped to match the banking angle in order to accommodate track base 36 at the same banking angle.

Figure 4:
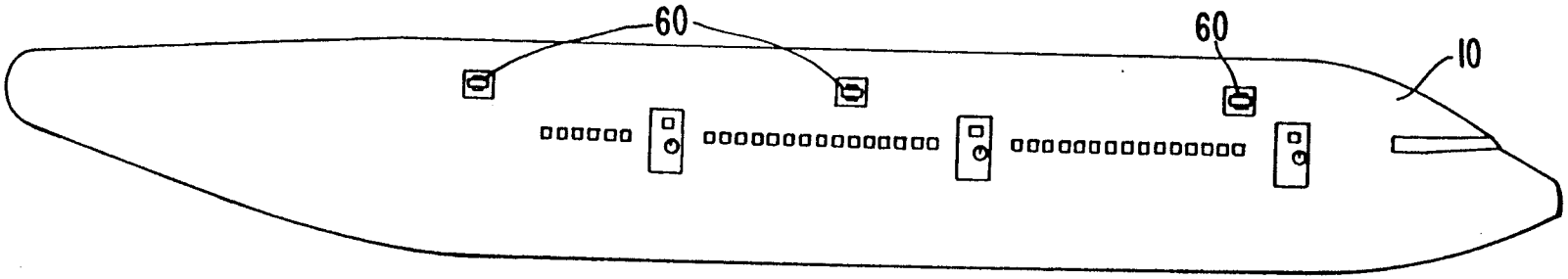
FIG. 4 is a side view of the vehicle shown in FIG. 1 to illustrate the guide wheels on the side of the vehicle.

As shown in FIGS. 1 and 4, vehicle 10 is configured to have the appearance of the fuselage of a modern day passenger or freight aircraft, and thus is aerodynamically designed to accommodate the high speeds, for example 150 mph to 300 mph, for which the guideway according to the invention is designed. The experience base that has been gained with regard to the aerodynamic design of modern day aircraft therefore may be directly applied to the rail vehicle used on the present guideway. The principal departure of the rail vehicle used on the novel guideway of the invention from that of an aircraft fuselage is that vehicle 10 has a recess 50 beneath the vehicle for accommodating a carriage 52 that mounts in-line wheels 54 (only one being shown) for engaging monorail 38. Carriage 52 additionally mounts a conventional drive assembly 56, such as a chain or bar drive, for rotating wheels 54. The propulsion system for supplying energy to the drive assembly may be electric or other conventional propulsion system known in the art. Vehicle 10 is additionally provided with guide wheels 60 that are mounted on the exterior of the vehicle at positions to provide rolling engagement with guide wheel running plates 40, 42. A set of, for example, three side wheels may be provided on each side of the vehicle as shown in FIG. 4.

The majority of the load of vehicle 10 is transmitted through in-line wheels 54 to monorail 38. The function of guide wheels 60 is, by rolling engagement with roller wheel guide plates 40, 42, to stabilize and balance the vehicle through the series of circular, track supporting rings 14.

The interior of vehicle 10 may be configured similarly to an aircraft with the usual seating 70 as shown in FIGS. 2 and 3 for a passenger vehicle, or with cargo space (not shown) for a freight vehicle.

The guideway also includes the usual electric power lines and control lines (not shown) for supplying power to the vehicle (in the case of an electric propulsion system) and other control and communication signals as generally required. It should be apparent that the guideway according to the invention is not limited to conventional rail vehicles, but could also be employed in connection with magnetically levitated vehicles.

While a preferred embodiment of the invention has been described and illustrated herein, it should be recognized that numerous modifications and variations of the disclosed embodiment may be made without departing from the scope of the invention as defined in the appended claims which therefore should not be limited to the details disclosed herein, but rather should be interpreted to embrace any and all equivalent apparatus.

What is claimed is:

1. A guideway for a vehicle, comprising:

a plurality of circular support rings, said plurality of rings being spaced apart along a desired path of travel of the vehicle;

means for mounting each said ring to a surface of the earth and for bracing each said ring against movement;

means defining a load bearing surface extending through the rings for accommodating a major load of the vehicle and comprising a monorail mounted in a lower region of said rings, said monorail for rolling engagement with in-line wheels on the vehicle; and two guide wheel running plates extending through said rings, said two guide wheel running plates being spaced apart from one another and from said monorail by an angle of about 120° and mounted on an inner circumference in an upper region of said rings for guiding the vehicle through rolling engagement with corresponding guide wheels mounted on the vehicle.

2. The guideway according to claim 1, wherein along a straight path with respect to an azimuth direction, said monorail is mounted so that it is aligned with a vertical axis passing through the center of the rings and the dead center bottom of said rings and said guide wheel running plates are mounted at an identical angular displacement with respect to the dead center bottom of the rings.

3. The guideway according to claim 2, wherein along a curved path in the azimuth direction said monorail is mounted so that it is offset from said vertical axis and said guide wheel running plates are correspondingly displaced along the circumference of said rings to accommodate a banking of the vehicle along the curved azimuth path.

4. The guideway according to claim 1, wherein said rings each comprises a steel I-beam or pipe bent in a circle.

5. The guideway according to claim 1, wherein said means defining a load bearing surface further comprises a steel reinforced concrete base, said monorail being mounted on said base.

6. The guideway according to claim 1, wherein said means for mounting and bracing each said ring includes support braces, each said brace being in a form of a steel beam having one end attached to the earth and a second end attached to said ring, with each said ring being attached to two said braces, one on each side of said ring with respect to vertical plane coincident with the center of the ring and aligned with the direction of travel of the vehicle.

7. The guideway according to claim 6, wherein said means for mounting and bracing each said ring comprises a clevis connecting the one end of each said support brace to said ring.

8. The guideway according to claim 1, wherein said means for mounting and bracing each said ring comprises a steel reinforced concrete base fixedly mounting said ring.

9. A guideway for a vehicle, comprising:

plural steel reinforced support bases each having a subterranean concrete footing;

a plurality of circular support rings, each ring being partially embedded within a respective steel reinforced support base, said plurality of rings being spaced apart along a desired path of travel of the vehicle;

plural support braces for bracing each said ring against movement, each said brace being in a form of a steel beam having one end attached to the earth and a second end attached to the exterior of said ring, with each said ring being attached to two said braces, one on each side of said ring with respect to vertical plane coincident with the center of the ring and aligned with the direction of travel of the vehicle;

a load bearing surface extending through the rings for accommodating a major load of the vehicle and comprising a steel reinforced concrete track base extending longitudinally through said rings and mounted on said support bases, and a monorail for rolling engagement with in-line wheels on the vehicle and being parallel to and mounted on said track base in a lower region of said rings, such that the load of the vehicle is directly born by said support base; and two guide wheel running plates extending longitudinally through said rings, said two guide wheel running plates being parallel to said monorail and being spaced apart from one another and from said monorail by an angle of about 120° and mounted on an inner circumference in an upper region of said rings for guiding the vehicle through rolling engagement with corresponding guide wheels mounted on the vehicle.

* * * * *